US005924933A

United States Patent [19]

Pacheco

[11] Patent Number: 5,924,933

[45] Date of Patent: Jul. 20, 1999

[54] GOLF TRAINING AID

[76] Inventor: Abelardo Pacheco, 509 Teak Dr., Lake Park, Fla. 33403

[21] Appl. No.: 09/066,152

[22] Filed: Apr. 24, 1998

[51] Int. Cl.[6] ..... A63B 69/36

[52] U.S. Cl. ..... 473/216; 473/277

[58] Field of Search ..... 473/215, 216, 473/277

[56] References Cited

U.S. PATENT DOCUMENTS

| | | | |
|---|---|---|---|
| 2,893,736 | 7/1959 | Tesi | 473/216 |
| 3,870,317 | 3/1975 | Wilson | 473/216 |
| 4,095,798 | 6/1978 | Marple | 473/147 |
| 5,358,250 | 10/1994 | Spencer | 473/216 |

*Primary Examiner*—George J. Marlo
*Attorney, Agent, or Firm*—McHale & Slavin

[57] ABSTRACT

Disclosed is a golf training method and apparatus that consists of an anchor tethering straps and waist belt positioned in such fashion so as to train an individual to prevent excess rotation or hip movement during a golf swing. The apparatus is universal having an adjustable strap that fits around the waist including tethering straps that allow for both width and height of adjustment of the individual. The device may be used outdoors by use of a portable anchor or permanent anchor, as well as indoors by use of a standing board allowing an individual to stand on top of a board with an anchor placed at the end of the standing board. The tethering straps are independently fixed during use. One of the tethering straps stretches and permits proper body rotation. The other strap is inelastic and controls body sway.

7 Claims, 2 Drawing Sheets

GOLF TRAINING AID

FIELD OF THE INVENTION

This invention relates to the game of golf and, more particularly, to a golf training aid that concentrates on hip positioning for muscle memory training.

BACKGROUND OF THE INVENTION

The game of golf is an immensely popular sporting activity played throughout the world. The premise of the game requires ball control for purposes of completing a course in as few strokes as possible. Technological advancements allow amateurs to obtain respectable scores, however, unless an individual has the proper form the possibility of competitive scoring will be elusive. Even if an individual has a good round of golf, repeatability is not possible unless the individual has what is known as a natural swing. Unless such form comes naturally to the individual, thousands of hours will be needed to perfect the form through muscle memory.

There are a number of devices in the marketplace for use in assisting a golfer to strike a ball consistently with a repeatable accuracy. One of the most defining factors in the swing is directed to the movement of the hips which, if not controlled properly, can diminish the effectiveness of the swing causing not only the loss of distance but a loss in accuracy. The result is a golfer who develops muscle memory leading to consistent play and a lower golf score.

U.S. Pat. No. 5,718,640 discloses a golf swing training device that includes a belt structure for placement around the waist and a strap member that is further secured around the arm portion of the individual so as to keep the elbow generally adjacent to the waist of an individual. This device does not enhance muscle memory of proper hip placement.

U.S. Pat. No. 5,690,494 discloses a teaching aid that employs a resilient cord attached between an upper body yoke and a fixed object. The resilient cord creates a resistance when the individual rotates their body to simulate rotational movement.

U.S. Pat. No. 5,651,680 discloses a teaching aid for conditioning a golfer to keep their head down. This device employs a tethering cord having one end attached to a mouthpiece and a second end secured to the individual's clothing. The device is designed to teach the proper swinging of a club wherein detachment of the cord from the individual's clothing indicates improper swing movement.

U.S. Pat. No. 5,672,115 discloses a golf swing training device. A tee is mounted on a tee platform, a taut movable cord is then attached to the hip of a golfer standing on the platform which is further attached to a sensing unit. The sensing device provides an audio and visual response if the hips of the individual move beyond a predetermined position. The device sensing unit generates a forward, rearward and fore-strike position signal based upon optimum positioning.

U.S. Pat. No. 5,591,090 discloses a golf training device having a platform with a leg stand. The leg stand is adjustable and provides a rest between the knee and mid-thigh to avoid swaying during a golf swing. The stand does not allow for flexing of the waist which is necessary during a golf swing.

Thus, while numerous golfing aides disclose devices for teaching swinging techniques, no known device concentrates on securing an individual's hips in a predefined position so as to train an individual on the proper coiling technique and resulting swing ratio. The maintaining of the hips in a near fixed position allows an individual to rotate their body in a coil-like fashion wherein the uncoiling of the body will allow the individual to obtain a greater club head speed and thereby longer distances. This technique allows an individual to become accustomed to a particular positioning of the body.

Thus what is lacking in the art is a portable device for purposes of training an individual in the proper positioning of their-hip for purposes of muscle memorization.

SUMMARY OF THE INVENTION

The instant invention includes a belt placed around an individual's waist which is secured to a fixed anchor by adjustable tethering straps. One of the tethering straps includes a biasing spring to allow a controlled movement of the hips in a range acceptable to a proper swing form. The biasing spring further inhibits excessive shock to the body when an individual is first learning proper hip positioning. A second strap inhibits hip rotation. The upper body is trained to twist creating a body torque motion which allows for greater distances while training the lower portion of the body to maintain a stable position thereby improving accuracy.

The device maintains the correct position of the body by providing a firm stable stance. The belt wraps around the body and is equipped with two O-rings placed on opposite sides of the body for attachment of the tethering straps. The tethering straps are between 3 and 5 feet in length and are equipped with swivel snap hooks for coupling between the o-rings of the belt and the anchor.

The preferred embodiment includes a portable anchoring device that is screwed into the ground. The preferred anchor is a coiled screw having a handle formed integral thereto for manual threading into soil. The individual is tethered to the anchor in such a manner so as to allow partial rotation while swinging a golf club. The anchor may include a swivel to allow the individual to move around the anchor without readjustment. This swivel allows an individual full alignment to strike a ball providing the individual instant feedback. The anchor may also be fixed, such as at a driving range, or be secured to an object such as a standing board. For instance, an anchor may be placed along one end of a board allowing the golfer to stand along an opposite end wherein the weight of the individual causes stability.

The apparatus provides an instructor with a valuable tool in teaching hip positioning, a skill that is frequently taught with the instructor having to physically hold the golfer's hips. The apparatus further allows an individual to train in the privacy of their own home or yard without the need for an instructor.

Thus, an objective of the instant invention is to provide a low cost portable training aid to teach proper body alignment for the enhancement of the game of golf.

Another objective of the instant invention is to assist a golfer in developing correct body torque and consistent ball contact by restricting unnecessary body movements.

Still another objective of the instant invention is to develop muscle memory while developing a basic golf swing.

Yet still another objective of the instant invention is to provide a low cost training tool that is universally adaptable to left or right handed golfers as well as adjustable to meet the particular size both of height and width of an individual.

Still another objective of the instant invention is to provide a means for teaching proper hip positioning without endangering an instructor who otherwise would need to physically hold the individual while the individual is swinging a golf club.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
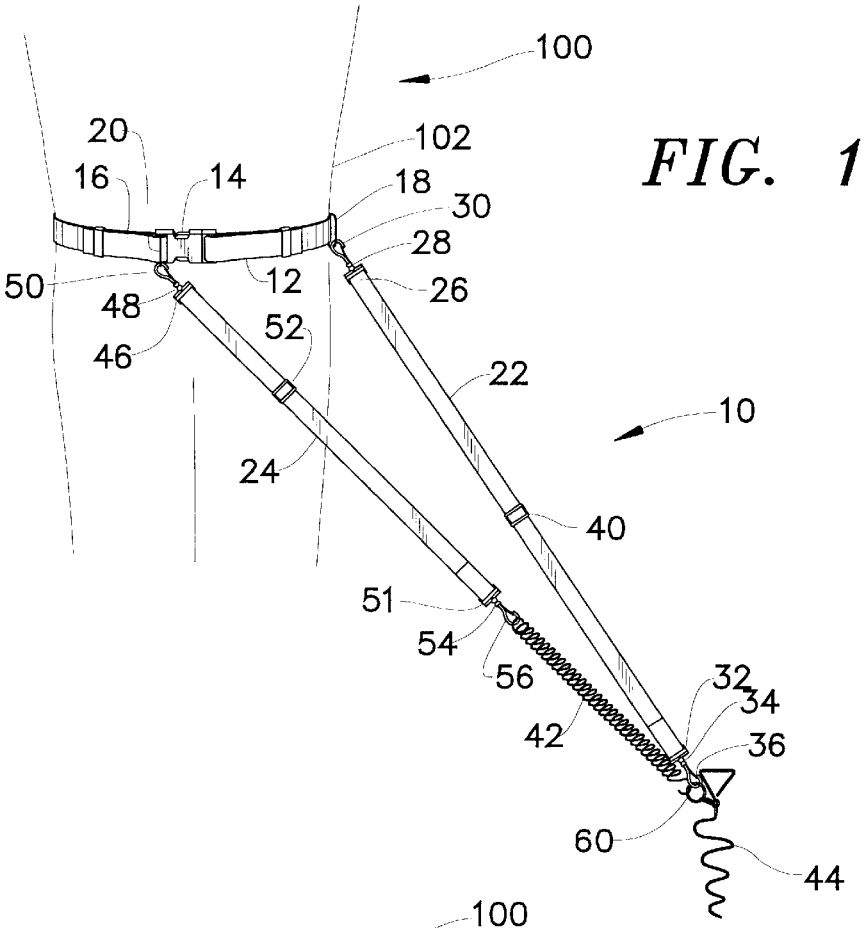
FIG. 1 is a pictorial view of a golfer having the instant invention secured to a portable anchor.
Figure 2:
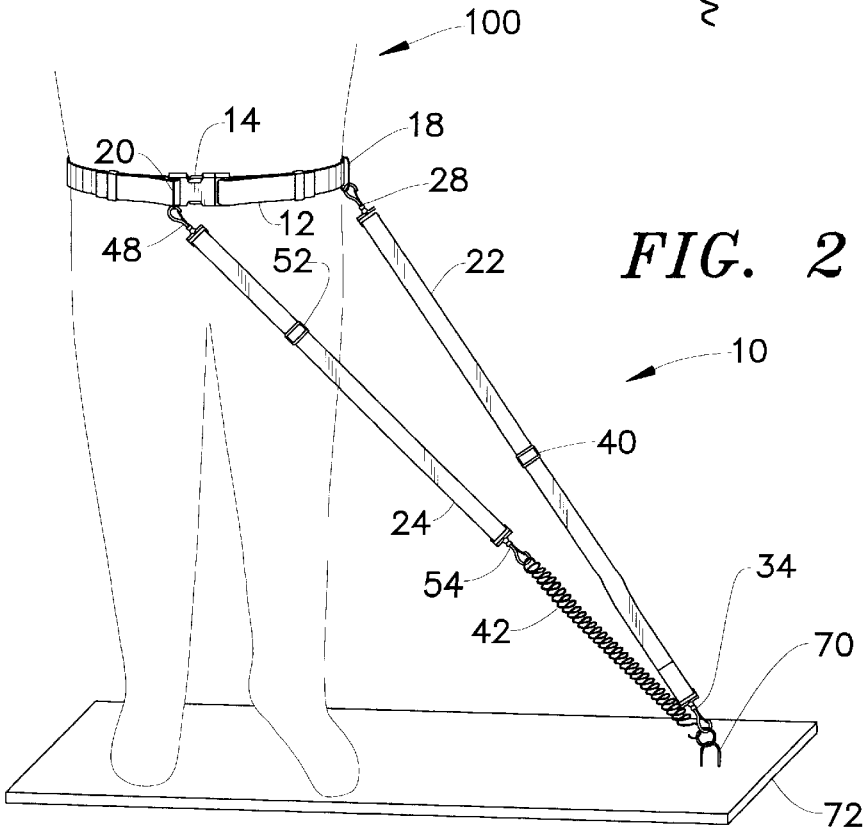
FIG. 2 is a pictorial view of a golfer having the instant invention secured to a fixed anchor.
Figure 3:
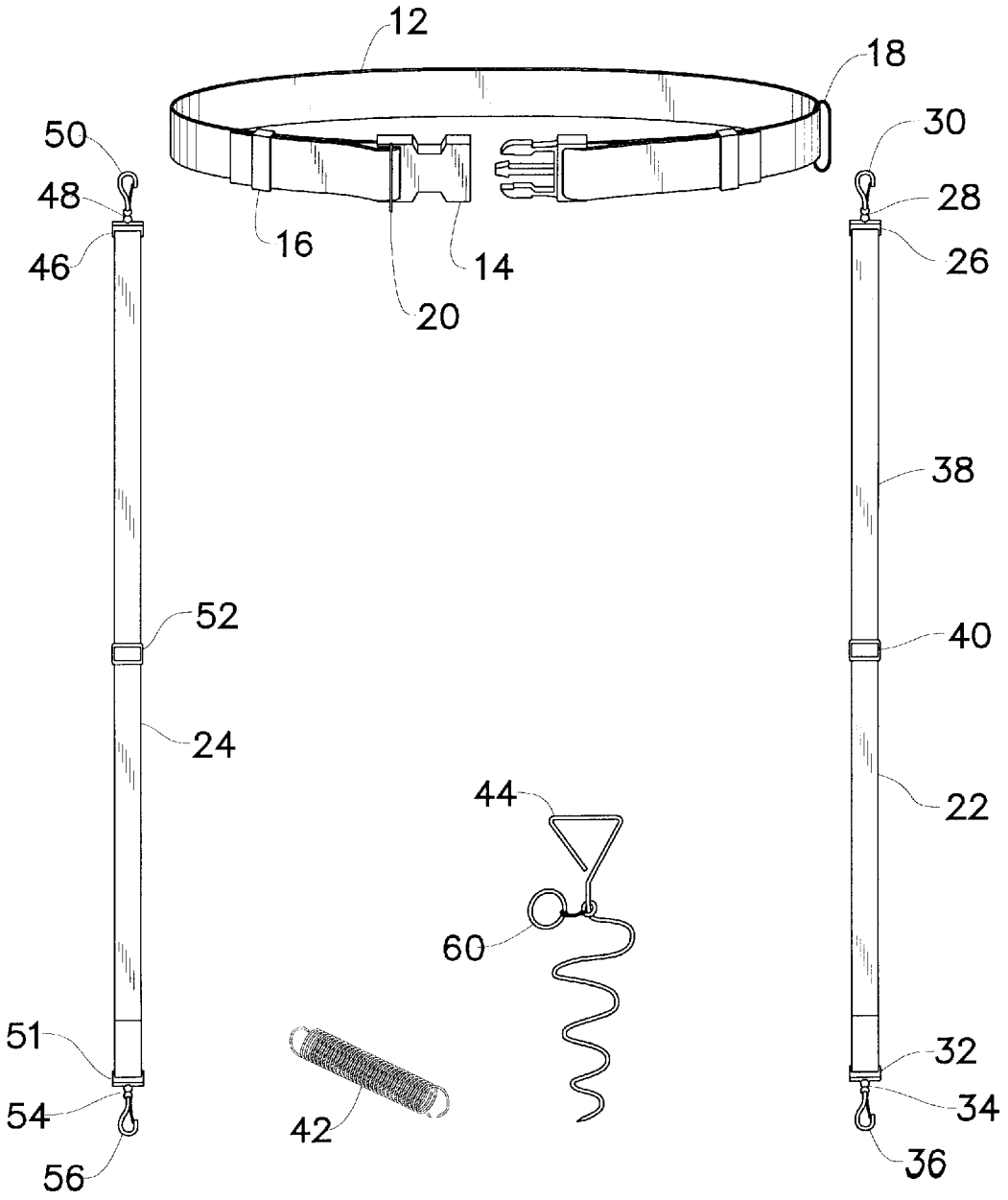
FIG. 3 is an exploded view illustrating individual components.

Referring now in general to FIGS. 1–3, a golfer 100 is illustrated with the golf training aid 10 placed in position for use. The training aid 10 includes a belt 12 formed from a flexible tethering strap having a coupling buckle 14 for ease of placement or removal. The belt 16 is adjustable to accommodate the waist dimensions of the individual and in the preferred embodiment is about 2 inches wide for distribution of pressure. It should be noted that any size and type of belt may be used and the size would not defeat the intent of this invention. The coupling buckle 14 simply allows an individual to reuse the item without adjustment.

In the preferred embodiment the belt 12 includes rings 18 and 20 which are oblong shaped so as to fit comfortably along side of an individual and provide an area for securing tethering straps thereto. Ideally the ring 18 is placed on the side of the individual and ring 20 along a frontal portion of the individual as illustrated for providing greater stability.

The belt 12 is coupled to tethering straps 22 and 24. Tethering strap 22 is further defined by a distal end 26 having a swivel member 28 allowing for ease of rotation of clip hook 30. The clip hoop secures to ring 18. Similarly a proximal end 32 of the tethering strap 22 includes swivel member 34 and snap hook 36 for coupling to anchor post 44. The tethering strap 22 is preferably constructed from a flexible material such as nylon, the length of which is adjustable by bracket 40.

Tethering strap 24 is further defined by a distal end 46 having a swivel member 48 allowing for ease of rotation of clip hook 50. Similarly a proximal end 51 of the tethering strap 24 includes swivel member 54 and snap hook 56 for coupling to anchor post 44 by use of biasing spring 42. The tethering strap 24 is also constructed from a flexible material such as nylon, the length of which is adjustable by bracket 52. However, the tethering strap 24 may be constructed from a material having an internal stretch characteristic that operates in the same manner as the aforementioned spring 42. In the preferred embodiment, the tethering strap 24 does not stretch wherein the spring 42 provides a predetermined amount of stretch to the assembly so as to accommodate the slight rotation of an individual while twisting in the follow through of a golf swing.

It is noted that the straps 22 and 24 are formed of identical material for purposes of manufacturing simplicity only. The swivel members allow adjustment without tangling or rotate the straps when placed between the anchor and belt. The use of identical straps is found to lower manufacturing costs, the rotating buckles provide ease of installation without having to untangle straps, and the adjustment buckles 40 and 52 allow for universal adaptability of the apparatus to any size golfer.

As shown in FIGS. 1 and 3, the anchor 44 consists of a spiral ground insert having a rotatable attachment clamp 60 to allow for ease of coupling the straps thereto. As shown in FIG. 2, an anchor ring 70 may be secured to standing board 72. The standing board is about 1 foot wide by three foot long allowing an individual to stand along one end of the standing board with an anchor ring placed along an opposite end. The standing board 72 allows the device 10 to be used indoors or whenever a ground anchor is not practical. For instance, if an individual is on soft ground, such as a driving range or in their backyard, the use of a screw anchor is most advantageous. If the individual is training indoors, the use of the standing board 72 is most advantageous.

It is noted that there are instances where an anchor is permanently mounted in the ground and its use is deemed within the scope of the invention although not illustrated. It should also be noted that an individual may use an existing belt or simply attach the device to belt loops to eliminate the need for a separate belt.

In operation the device is employed as follows. The anchor 44 is driven into the ground preferable at a 45 degree angle towards the target. The angle helps stabilize the anchor should the golfer exhibit excessive pull on the anchor during the rotation process. The proximal end of strap 24 is then secured to the anchor 44. The spring 42 is similarly secured to the anchor on one end and on the opposite end is secured to strap 22.

The individual would then install the belt 12 around the waist with the coupling 14 securing the belt in a fixed position. The O-rings are positioned along each side of the individual in such a position so as to prevent the belt or anchors from rotating or sliding about the waist. The snap hook 30 of the distal end 26 of strap 22 is secured to one of the rings with snap hook 50 of distal end 46 of strap 24 coupled to the opposite ring. Straps 22 and 24 may then be adjusted in a taut position wherein an individual may stand upright with their knees slightly bent without providing excessive force on the anchor or the individual's waist.

The individual then stands in a position parallel to the anchor and with a golf club in hand may swing wherein the straps or the apparatus will prevent the body from moving which is a natural tendency for amateur golfers. The result will be training of the muscles in a muscle memory fashion allowing for consistency through repeatability of the swing.

Proper positioning of the body in relation to the anchor further prevents a properly swung club from interfering with the straps. If the club is not being swung correctly or the body is rotating incorrectly the individual may strike a portion of the strap. A properly swung club will allow an individual to move freely without interfering with the straps and thereby enhancing muscle memory.

In this manner, the apparatus can be used as a method for teaching proper hip positioning for a golfer wherein the steps would comprise: (1) locating an anchor at ground level; (2) fastening a strap around the waist of the golfer; (3) coupling a first tethering strap between said anchor and said belt; (4) coupling a second tethering strap between said anchor and said belt; (5) positioning the golfer in a stance parallel to said anchor; and (6) adjusting said tethering belts until they are taunt.

The method could include the placement of a biasing spring between one of the straps and the anchor. Alternatively, one strap could be made of an elastic or the like stretchable material. The anchoring means for the method would include threading a coiled screw into the ground; or the use of a standing board having an anchor ring secured to one end for placement beneath the golfer wherein the golfer's weight maintains the standing board and anchor ring in a fixed position.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A golf training aid comprising:

an adjustable belt having a first coupling ring secured along a side surface of said belt and a second coupling ring secured along a frontal surface of said belt, said belt sized for placement around an individual's waist with said first coupling ring being positioned along a lateral region of the individual's waist during use, and with said second coupling ring being juxtaposed substantially with the individual's frontal region during use;

a first stretchable adjustable tethering strap having a swivel mounted releasable snap hook secured to a proximal end and a swivel mounted releasable snap hook secured to a distal end, said distal end coupled to said second coupling ring;

a second inelastic, yet adjustable tethering strap having a swivel mounted releasable snap hook secured to a proximal end and a swivel mounted releasable snap hook secured to a distal end, said distal end coupled to said first coupling ring; and an anchoring means, said anchoring means coupled to said proximal ends of said first and second tethering strap, said anchoring means cooperating with said tethering straps, so that the individual's feet are disposed on one side of said anchoring means during use;

whereby said belt is secured about an individual's waist with said tethering straps coupling said belt to said anchoring means wherein the hips of the individual are limited in movement by the tethering straps when the individual swings a golf club, said first tethering strap guiding the pivoting of the individual's first hip about the individual's second hip, said second tethering strap positioning the individual's second hip with respect to said anchoring means.

2. The golf training aid according to claim 1 wherein said anchoring means is defined as a coiled screw having a handle formed integral thereto for manual threading into soil.

3. The golf training aid according to claim 1 wherein said anchoring means is defined as an anchor ring secured to a standing board, said standing board sized to allow an individual to stand along one end with said anchor ring disposed along an opposite end.

4. The golf training aid according to claim 2 wherein said first tethering strap includes a biasing spring.

5. The golf training aid according to claim 4 wherein said biasing spring is juxtaposed with said proximal end of said first tethering strap.

6. The golf training aid according to claim 4 wherein said biasing spring is juxtaposed with said distal end of said first tethering strap.

7. The golf training aid according to claim 4 wherein said biasing spring is disposed between said proximal end of said first tethering strap and said distal end of said first tethering strap.

* * * * *